United States Patent [19]

Wilson

[11] 4,078,836

[45] Mar. 14, 1978

[54] SECURITY DEVICE FOR A DOOR

[76] Inventor: Delmar F. Wilson, 5034 S. 142nd St., Omaha, Nebr. 68137

[21] Appl. No.: 784,980

[22] Filed: Apr. 6, 1977

[51] Int. Cl.[2] ..... E05C 19/00

[52] U.S. Cl. ..... 292/259 R; 292/338

[58] Field of Search ..... 292/338, 339, 259, 260

[56] References Cited

U.S. PATENT DOCUMENTS

| | | | |
|---|---|---|---|
| 1,010,365 | 11/1911 | Hensle | 292/346 X |
| 1,114,510 | 10/1914 | Owens | 292/259 X |
| 1,779,491 | 10/1930 | Rau | 292/259 |

*Primary Examiner*—Richard E. Moore

*Attorney, Agent, or Firm*—Zarley, McKee, Thomte, Voorhees & Sease

[57] ABSTRACT

A security device for a door comprising first and second support brackets which are secured to the door and the door casing or the like at opposite sides of the door. Each of the support brackets comprises a vertical portion which is secured to the casing and a horizontal portion which is secured to the floor. A diagonally extending brace member extends between the vertical and horizontal bracket portions and cooperates with the vertical portion to define a channel. The length adjustable bar is adapted to have its opposite ends received by the channels in the brackets to prevent the opening of the door as desired.

4 Claims, 5 Drawing Figures

SECURITY DEVICE FOR A DOOR

BACKGROUND OF THE INVENTION

This invention relates to a security device for a door and more particularly to a security device which positively prevents the door from being opened by an intruder or the like.

Many types of security devices have been provided for doors in an effort to prevent the unauthorized opening of the same. However, the conventional security devices are not as strong as necessary. Additionally, certain of the security devices are not aesthically pleasing.

Therefore, it is a principal object of the invention to provide an improved security device for a door.

A still further object of the invention is to provide a security device for a door comprising an elongated bar member which extends between a pair of brackets which are secured to the floor and the door casing at opposite sides of the door.

A still further object of the invention is to provide a security device for a door which may be used on various door widths.

A still further object of the invention is to provide a security device for a door which is durable in use, refined in appearance and economical of manufacture.

These and other objects will be apparent to one having skill in the art.

SUMMARY OF THE INVENTION

A pair of support brackets are secured to the door casing or the wall itself at opposite sides of the door. Each of the support brackets comprises a vertical leg portion having a horizontal leg portion extending from the lower end thereof. The vertical leg portion is secured to the door casing or the wall with the horizontal leg portion being secured to the floor. A diagonally extending brace portion is secured to and extends between the horizontal and vertical leg portions to strengthen the same and to cooperate with the vertical leg portion to define a channel adapted to receive one end of a length adjustable security bar. When the security bar is extended between the channels, the bar prevents the inward opening of the door.

DESCRIPTION OF THE PREFERRED EMBODIMENT

Figure 1:
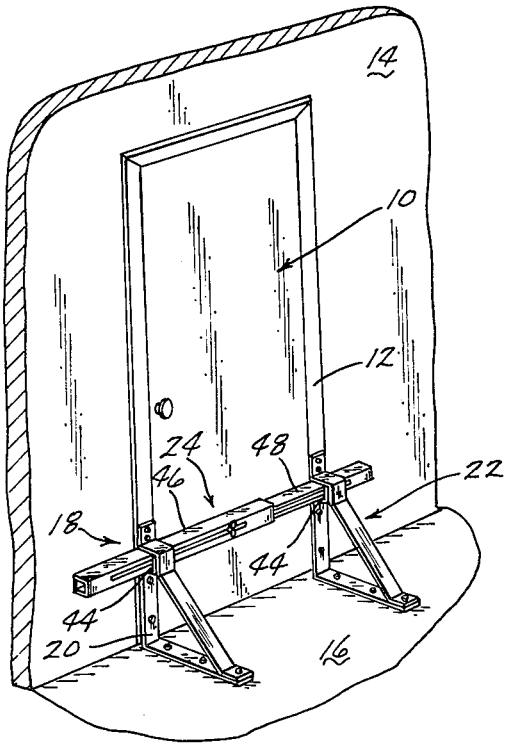
FIG. 1 is a perspective view of the apparatus in use.

Referring to FIG. 1, the numeral 10 refers to a conventional door which is hingedly mounted in a casing 12 or the like which is positioned in a wall 14 extending upwardly from floor 16. The security device of this invention is referred to generally by the reference numeral 18 and generally comprises bracket members 20 and 22 and bar 24. Inasmuch as the bracket members 20 and 22 are identical, only bracket member 20 will be described in detail with "'" indicating identical structure on bracket member 22.

Figure 2:
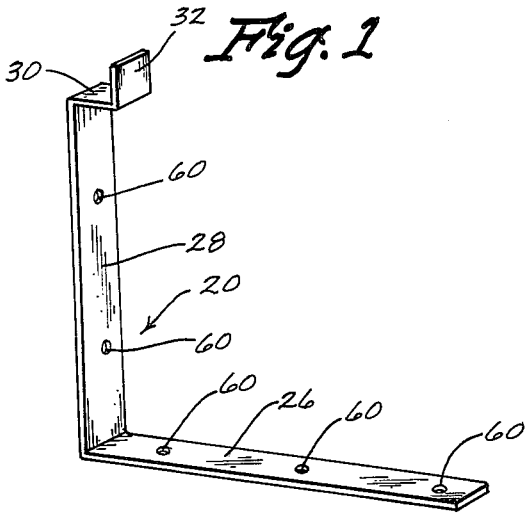
FIG. 2 is a perspective view of one portion of one of the brackets.
Figure 5:
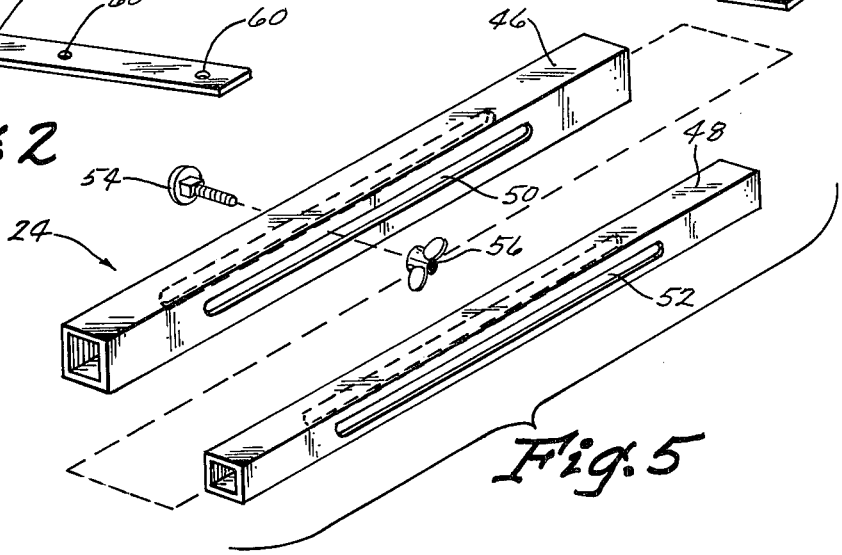
FIG. 5 is an exploded perspective view of the security bar.

Bracket member 20 comprises a horizontal leg portion 26 having a vertical leg portion 28 extending upwardly from the inner end thereof. As seen in FIG. 2, vertical leg portion 28 has a horizontal portion 30 and vertical portion 32 at the upper end thereof.

Figure 4:
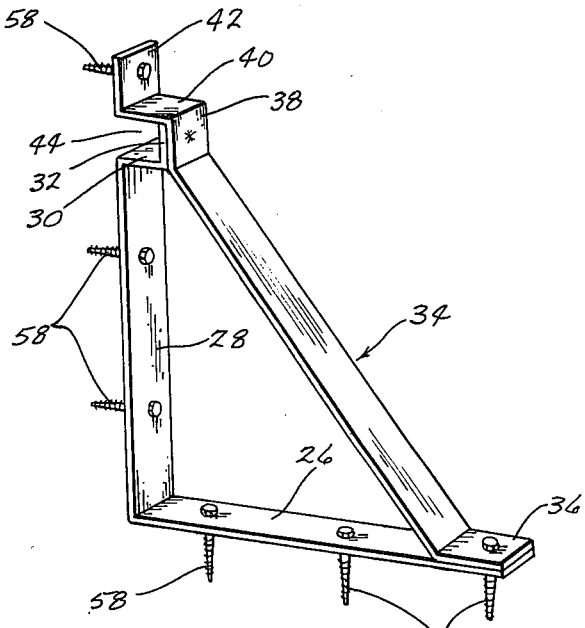
FIG. 4 is a perspective view of the assembled bracket.
Figure 3:
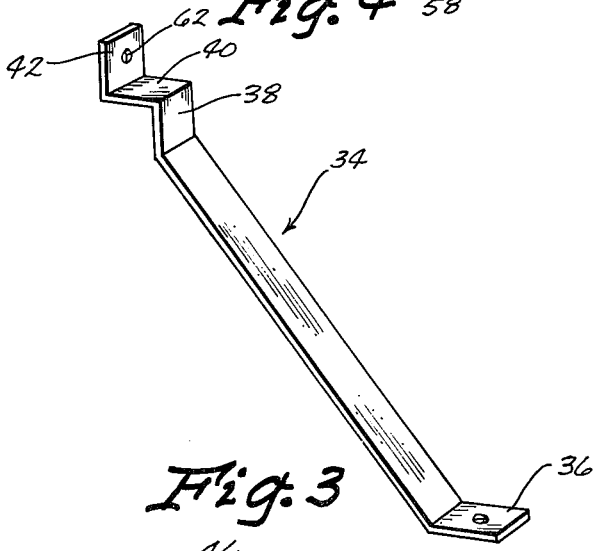
FIG. 3 is a perspective view of the diagonal brace portion of each of the brackets.

The numeral 34 refers to a diagonally brace portion which is illustrated in FIG. 3. Brace portion 34 includes a horizontally disposed portion 36 at its lower end which is spot-welded to the outer end of leg portion 26. The upper end of brace portion 34 is provided with vertical portion 38, horizontal portion 40 and vertical portion 42. Vertical portion 38 is spot-welded to vertical portion 32 in the manner illustrated in FIG. 4. It can be seen in FIG. 4 that horizontal portion 40 is spaced above horizontal portion 30 so as to define a channel 44.

Bar 24 is preferably comprised of a pair of bar members 46 and 48 having slots 50 and 52 formed therein respectively. The bar members 46 and 48 are length-adjustably secured together by means of bolt 54 and wing nut 56. Although bar 24 is preferably of the length-adjustable type so as to accomodate various door widths, the bar 24 may be comprised of a single member.

In use, bracket member 20 is secured to the casing 12 and floor 16 at one side of the door by extending screws or the like through the screw openings 58 in leg portion 28 and extending screws through the screw opening 60 in horizontal leg portion 26. Screws are also extended through the screw openings 62 in brace 34. Thus, the bracket 20 is secured to the door casing and to the floor which provides great strength to the device and which prevents the device from being riped or torn from the wall. While the bracket 20 has been described as being secured to the door casing, it should be understood that the bracket could be secured to the wall itself if desired. The bracket number 22 is similarly secured to the wall and casing.

When it is desired to secure the door from unauthorized opening, a bar 24 is simply extended between the channels 44 and 44' of the bracket members 20 and 22. Thus, if an attempt is made to open the door, the bar will be positioned in the pivotal path of the door and will be maintained in the brackets by the channels 44 and 44'. When the bar 24 is not in use, it may be conveniently stored and can be seen from FIG. 1 that the bracket members 20 and 22 provide a pleasant aesthetic appearance.

Thus it can be seen that the security device accomplishes at least all of its stated objectives.

I claim:

1. A locking apparatus for a door hingealy mounted in a support means which extends upwardly from a floor, comprising, a first support member operatively secured to said support means and said floor adjacent a first side edge of said door, a second support member operatively secured to said support means and said floor adjacent a second side edge of said door, each said support members having a channel means formed therein, and an elongated member having opposite ends removably received by said channel means in each of said support members for preventing the opening of said door, said elongated member being length adjustable.

2. A locking apparatus for a door hingealy mounted in a support means which extends upwardly from a floor, comprising, a first support member operatively secured to said support means and said floor adjacent a first side edge of said door, a second support member operatively secured to said support means and said floor adjacent a second side edge of said door, each said support members having a channel means formed therein, and an elongated member having opposite ends removably received by said channel means in each of said support members for preventing the opening of said door, each of said support members comprising a vertical leg portion secured to said support means, and a horizontal leg portion extending from the lower end of said vertical leg portion, said horizontal leg portion being secured to said floor, each of said support members also comprising a diagonally extending brace portion which is secured to and extends between said vertical and horizontal leg portions.

3. The apparatus of claim 2 wherein said vertical portion and brace portion cooperate to define said channel means.

4. The apparatus of claim 3 wherein each of said channel means is defined by a lower horizontal portion, vertical portion extending upwardly from said lower horizontal portion and spaced from said support means, and a horizontal top portion extending towards said support means from the upper end of said vertical portion.

* * * * *